US006009805A

United States Patent [19]

Miketa et al.

[11] Patent Number: 6,009,805

[45] Date of Patent: Jan. 4, 2000

[54] PRINTER

[75] Inventors: Tsutomu Miketa, Saitama-ken; Tadao Kashiwaba; Takeo Takahashi, both of Iwate-ken, all of Japan

[73] Assignee: Kabushiki Kaisha Sato, Japan

[21] Appl. No.: 09/051,033

[22] PCT Filed: Aug. 6, 1997

[86] PCT No.: PCT/JP97/02723

§ 371 Date: Mar. 31, 1998

§ 102(e) Date: Mar. 31, 1998

[87] PCT Pub. No.: WO98/06586

PCT Pub. Date: Feb. 19, 1998

[30] Foreign Application Priority Data

Aug. 8, 1996 [JP] Japan ..... 8-225975
Aug. 8, 1996 [JP] Japan ..... 8-225984

[51] Int. Cl.[7] ..... B41J 1/60

[52] U.S. Cl. ..... 101/111; 101/109

[58] Field of Search ..... 101/111, 109, 101/105, 103

[56] References Cited

U.S. PATENT DOCUMENTS

| | | | |
|---|---|---|---|
| 3,889,594 | 6/1975 | Nicholson | 101/111 |
| 4,170,938 | 10/1979 | Sato | 101/111 |
| 4,662,276 | 5/1987 | Schrotz | 101/111 |
| 4,679,500 | 7/1987 | Volk | 101/111 |
| 5,619,916 | 4/1997 | Sekine | 101/109 |

FOREIGN PATENT DOCUMENTS

| | | | |
|---|---|---|---|
| 2260276 | 12/1971 | Germany | 101/111 |
| 0628420 | 11/1993 | Germany . | |
| 57-46898 | 3/1982 | Japan . | |
| 61-83090 | 4/1986 | Japan . | |
| 6-155878 | 6/1994 | Japan . | |
| 2064435 | 6/1981 | United Kingdom | 101/111 |

*Primary Examiner*—Ren Yan
*Assistant Examiner*—Anthony H. Nguyen
*Attorney, Agent, or Firm*—Ostrolenk, Faber, Gerb & Soffen, LLP

[57] ABSTRACT

The object is to provide a printing apparatus wherein the rotation of endless printing bands is limited in a manner that keeps excessive rotational force from acting on the endless printing bands 7 themselves, thereby avoiding wear, cracking and other damage, and wherein forcible rotation of the endless printing bands causes idle rotation of selector wheels 5 and puts only moderate load on the endless printing bands. Attention is directed to adoption of selector wheel 5 rotation restricting members of a movable type and to enabling the movable stop members 14 to move when excessive force acts on the selector wheels 5 or the endless printing bands 5. A stop bearing member 15 is provided to abut on elastic sections 14B of the movable stop members 14, and engagement between drive projections 7E and the elastic sections 14B with movement of the endless printing bands 7 enables movement of the movable stop members 14.

14 Claims, 13 Drawing Sheets

PRINTER

TECHNICAL FIELD

This invention relates to a printing apparatus, particularly to a device for preventing display character fouling in a printing apparatus installed in portable label printing and affixing apparatus (hand labeler) or the like.

BACKGROUND ART

The printing apparatus of a hand labeler generally has selector wheels supported on a shaft at one end portion of a printer frame and a type bearing member section at the other end portion of the frame. Endless printing bands made of a flexible material such as rubber or synthetic resin and formed on their outer surfaces with types and display characters are wound around the selector wheels and the type bearing member section. The selector wheels are rotated to rotate the endless printing bands to locate desired types on the outer surfaces of the type bearing member section where they can be printed, ink is applied to the types by an ink roller or the like, and the types can then be impressed on a label or the like.

Each endless printing belt is formed with types around one half its perimeter and display characters around the other half of its perimeter, the arrangement being defined so that the display character at the position viewable through a display window section provided in the printer frame corresponds to the type positioned at the type bearing member section.

Prescribed types can therefore be positioned at the type bearing member section by using a type select operating shaft to rotate the selector wheels while viewing the display characters through the display window section.

However, if an endless printing band is rotated beyond the prescribed rotation range when it is rotated by operating the type select operating shaft, the display characters may be rotated as far as the type bearing member section and be fouled by application of ink thereto by the ink roller. This leads to such problems as that the display characters become hard to see when selecting prescribed types while viewing the display characters through the display window section.

Various proposals have been made for preventing this fouling of the display characters (by ink application prevention means). In the "printing band structure" of Japanese Patent Publication No. Sho 62(1987)-33080, for example, a projection is provided on a rotating disk for rotating the endless printing band and a stop is provided in the vicinity of the rotation range region of the endless printing band. Owing to abutment of the projection on the stop, the rotating disk can rotate only within the prescribed region.

However, this device involves problems such as that the projection interferes with the display characters and that if the rotating disk is rotated with excessive force after the projection strikes on the stop, the endless printing band may elongate, causing it to print improperly or fall off.

Further, in the "printer" of Japanese Patent Application Laid-open No. Hei 6(1994)-155878, a protuberance is formed on the outer peripheral surface of the endless printing band to be engageable with a stop and the crest surface of a drive projection engaging with an indentation provided on the periphery of the selector wheel is formed as a slanted surface. When a selector wheel is forcibly rotated after the endless printing band has reached the limit position, the endless printing band slips.

In this printing apparatus, however, the problem arises that the slipping at the time the endless printing band is rotated with excessive force wears, cracks and otherwise damages the slanted surface of the endless printing band.

Moreover, since the outer peripheral surface of the endless printing band is formed with the protuberance, the problem arises that the number of type that can be provided on the endless printing band decreases.

Further, in the "device for preventing fouling of printer display characters" of Japanese Utility Model Application Laid-open No. 6(1994)-71146, the rotation range of the endless printing band is limited by abutment of a sectionally thick type portion formed on the outer perimeter of the endless printing band with a leg portion of an indicator.

Damage of the indicator and damage of the endless printing band by cracking and the like when excessive rotational force are also a problem in this device. Another problem is that the endless printing band may pass beneath the indicator.

In "printer" of Japanese Patent Publication No. Hei 4(1992)-34951, on the other hand, rotation of the endless printing band is limited by engagement between a tooth formed on the endless printing band and a stop shoulder. This printing apparatus also has problems in that application of excessive rotational force elongates the endless printing band and causes wear, cracking and other damage.

Thus in all of these configurations the attempt to prevent fouling of the display characters by limiting rotation of the endless printing band to a prescribed region makes it difficult to avoid the direct or indirect action of large external forces on the endless printing band. They therefore encounter the problems of elongation and damage, the problem that the original purpose cannot be achieved because the projections ride over the stops, and other problems.

This invention was accomplished in the light of the aforesaid problems and has as an object to provide a printing apparatus which prevents fouling of the display characters on an endless printing band by keeping them from being positioned at the type bearing member section, i.e., from being brought opposite the ink roller.

Another object of the invention is to provide a prnting apparatus wherein the rotation of an endless printing band is limited in a manner that keeps excessive rotational force from acting on the endless printing band itself, thereby avoiding wear, cracking and other damage.

Another object of the invention is to provide a printing apparatus which minimizes the reduction in number of type caused by formation of a projection for limiting rotation of an endless printing band.

Another object of this invention is to provide a printing apparatus wherein forcible rotation of an endless printing band at its rotation limit causes idle rotation of the selector wheel and puts only moderate load on the endless printing band.

Another object of this invention is to provide a printing apparatus wherein the tension (degree of tautness) of an endless printing band can be regulated within a prescribed range.

DISCLOSURE OF THE INVENTION

A first aspect of the invention is directed to enabling idle rotation of the selector wheels by adopting selector wheel rotation restricting members (movable stop members) of a movable type having elastic sections, enabling the movable stop members to move when excessive force acts on the selector wheels or the endless printing bands, and allowing the engaged state of the endless printing bands with the selector wheels to become a partially engaged state therewith to produce slack. According to this first aspect of the invention, a printer having at least one endless printing band formed on its outer peripheral surface with multiple types and display characters and wound about a selector wheel and a type bearing member section and enabling selection of a desired type of the endless printing band is characterized in comprising a movable stop member provided between the selector wheel and the type bearing member section and formed at one end portion with at least one regulating boss portion for engaging the selector wheel and provided at another end portion thereof with an elastic section having at least one engagement piece, a stop bearing member for restricting movement of the movable stop member by abutting on the elastic section of the movable stop member, and at least one drive projection provided on an inner peripheral surface of the endless printing band to be engageable with the engagement piece of the elastic section of the movable stop member, engagement between the drive projection and the engagement piece with movement of the endless printing band causing movement of the movable stop member to enable release of the engagement between the selector wheel and the regulating boss section.

To stabilize the moving action of the movable stop member, the printer can be provided with a stop guide for guiding the movable stop member in its movement direction.

The elastic section can have a bifurcated engagement spring section. Since the bifurcated engagement spring section can elastically deform laterally with movement of the movable stop member in the vertical direction, for example, the engagement between the drive projection of the endless printing band and the elastic section can be further strengthened and the movable stop member can effect smooth elastic movement.

The stop bearing member can have a slanted bearing surface for bearing the elastic section. Since the elastic section is elastically deformed along the slanted bearing surface when the movable stop member moves, the engagement between the drive projection of the endless printing band and the elastic section can be further strengthened and the movable stop member can effect smooth elastic movement.

The endless printing band can have at least one blank section with no types on its peripheral surface and the inner peripheral surface at least one display character adjacent to the side of the blank section in the direction of rotation can be made a flat section.

Specifically, the inner peripheral surface at least one display character adjacent to the side of the blank section in the direction of rotation can be formed without projections capable of engaging with the selector wheel, thereby avoiding engagement between the selector wheel and the endless printing band and facilitating idle rotation of the selector wheel.

According to a second aspect of the invention, a printing apparatus having at least one endless printing band formed on its outer peripheral surface with multiple types and display characters and wound about a selector wheel and a type bearing member section and enabling selection of a desired type of the endless printing band is characterized in comprising a stop member provided between the selector wheel and the type bearing member section and at least one drive projection provided on an inner peripheral surface of the endless printing band to be engageable with the stop member, engagement between the drive projection and the stop member with movement of the endless printing band producing slack in the endless printing band to enable idle rotation of the selector wheel.

In the device for preventing display character fouling in a printer according to this invention, the regulating boss portion and the elastic section are formed on the movable stop member, the regulating boss portion engages with the selector wheel, and the elastic section elastically deforms. As a result, regulation of the endless printing band type selection operation (appropriate set states of individual types at the type bearing member section and differentiation of the set states) can be secured.

Therefore, while types and display characters of the endless printing band can be selected as desired by rotating the selector wheel to rotate the endless printing band thereabout, a drive projection of the endless printing band engages with the elastic section of the movable stop member just before a display character strikes (contacts) the ink roller to produce a sensation of resistance (resistance action) tending to once halt the rotation.

When an attempt is made to rotate the selector wheel beyond the point of this resistance action, the elastic section elastically deforms and the movable stop member itself moves slightly toward the type bearing member section side.

In this way, the rotational traction between the regulating boss portion of the movable stop member and the selector wheel decreases below that in the normal type selection state and, in addition, the endless printing band slackens from its engagement point with the selector wheel to its engagement point with the elastic section of the drive projection, thereby releasing its engagement with the selector wheel and allowing the selector wheel to rotate idly.

Since the display characters are therefore not rotated to and positioned at the rotation region of the ink roller, fouling thereof can be prevented. Moreover, any excessive force acting to rotate the selector wheel further is transferred through the endless printing band and a drive projection thereof to the elastic section of the movable stop member, whereafter it acts in the direction of producing idle rotation between the regulating boss portion of the movable stop member and the selector wheel and does not damage the endless printing band.

Since the drive projection is provided on the inner peripheral surface of the endless printing band and made engageable with the elastic section of the movable stop member, there is no reduction of the numbers of types and display characters on the peripheral surface of the endless printing band.

In the second aspect of the invention, slack is produced in the endless printing band when its rotation is prevented by its engagement with the stop member, the selector wheel and the endless printing band are put in a released state or in a state in which, even if they contact, rotation of the selector wheel does not act on the endless printing band, the selector wheel rotates idly, the endless printing band does not move to move the display characters as far as the type bearing member section, and the possibility of the display characters being fouled by contact with the ink roller is eliminated.

A third aspect of the invention is characterized in that a cam member whose rotational position can be adjusted is provided within the endless printing band to be rotatable into and out of contact with the inner peripheral surface of the endless printing band. In this case, the tension of the endless printing band can be adjusted by rotating the cam member to vary the degree of contact between the cam member and the endless printing band.

BEST MODE FOR CARRYING OUT THE INVENTION

Figure 1:
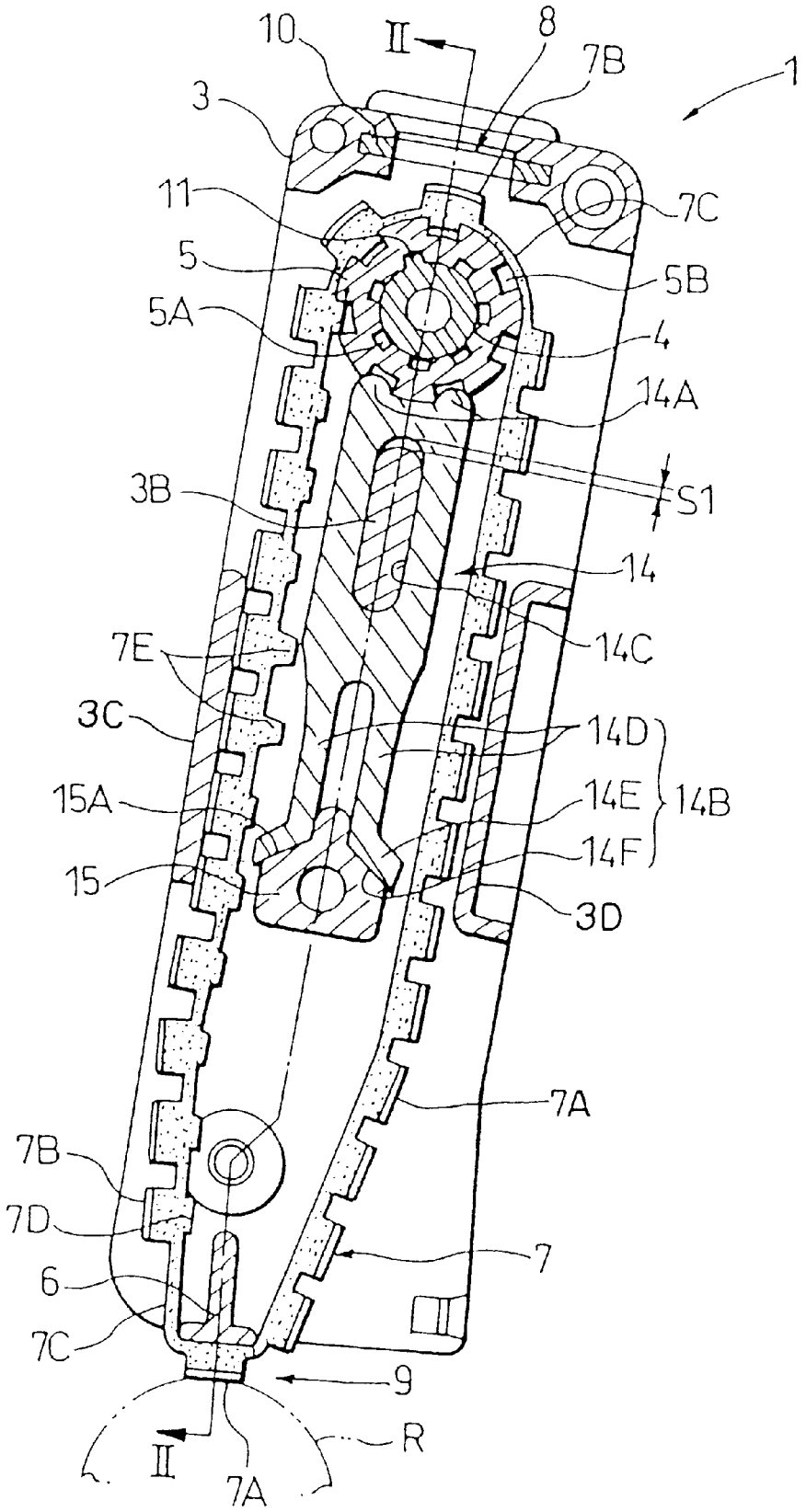
FIG. 1 is a sectional view of a printer according to the first aspect of the invention.
Figure 2:
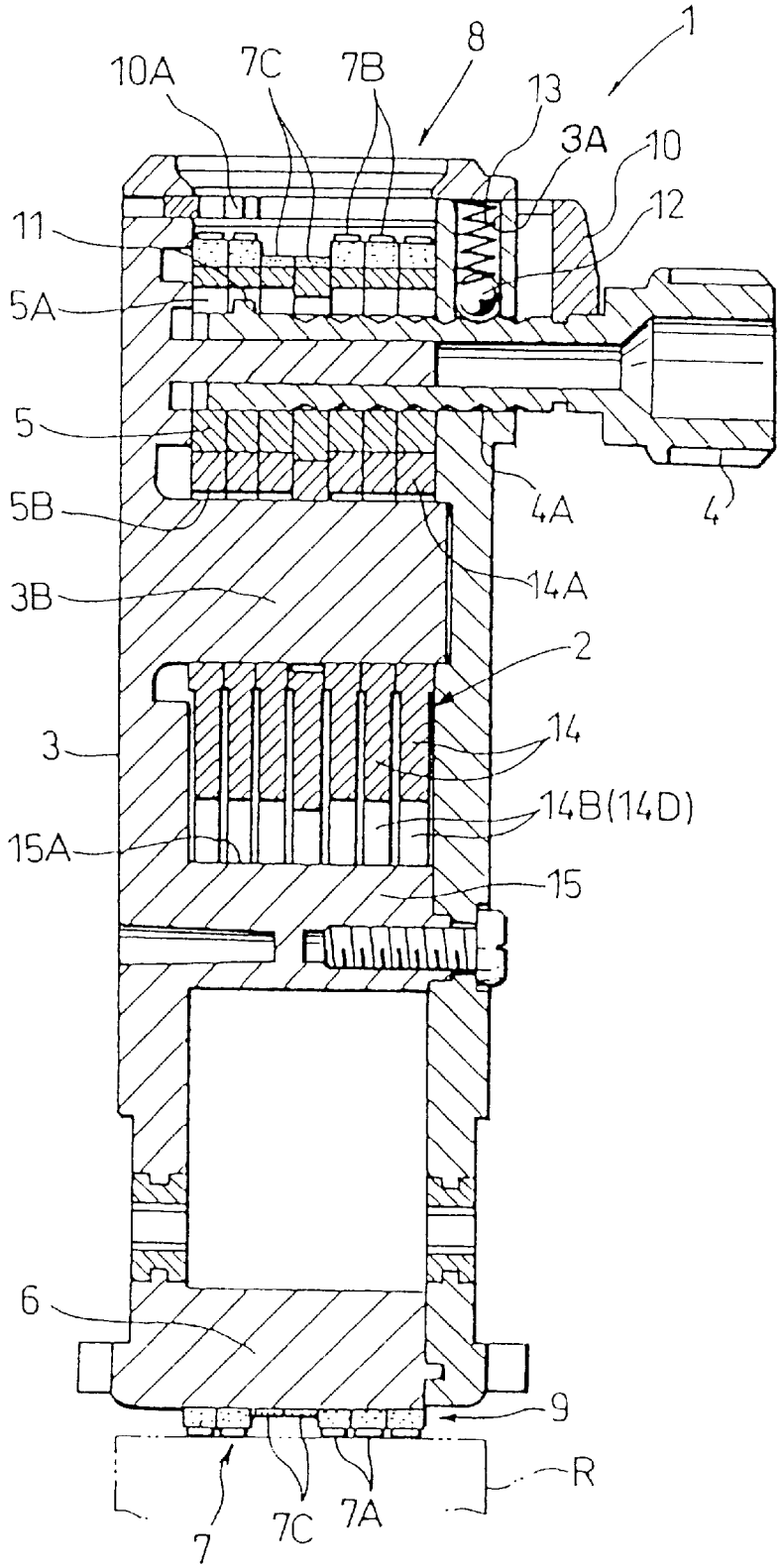
FIG. 2 is a sectional view taken along line II—II in FIG. 1.

In FIGS. 1 and 2, one end portion of a printer frame 3 of a printer 1 is provided with multiple selector wheels 5 which are selectively rotatable by an operating shaft 4 for type selection, the other end portion thereof is provided with a type bearing member section 6 of T shape section extending parallel to the operating shaft 4 for type selection, and endless printing bands 7 are wound about the selector wheels 5 and the type bearing member section 6 under prescribed tension. That is, multiple rows of the endless printing bands 7 are wound about the selector wheels 5 and the type bearing member section 6.

A display window 8 is formed as an opening in the printing apparatus frame 3 at an end surface portion thereof facing the selector wheels 5 and the end surface portion provided with the type bearing member section 6 is formed with an ink roller access opening 9. An ink roller R can move into contact with the endless printing bands 7 at the ink roller access opening 9.

The operating shaft 4 is used to select specific types of the endless printing bands 7 by moving it in the axial direction to select (locate) a desired row of the endless printing bands 7 and rotating the selector wheel 5 of the located row. The operating shaft is mounted with respect to the printing apparatus frame 3 to be movable in the direction of its axis and to be rotatable about its axis. Its outer peripheral surface is formed with multiple locator grooves 4A spaced regularly in the axial direction and a rotary pin 11 is formed to project for near its tip.

On the other hand, the printing apparatus frame 3 is formed with a vertical hole 3A for accommodating a steel locator ball 12 and the steel locator ball 12 accommodated in the vertical hole 3A is urged toward the locator grooves 4A by a locator spring 13 to engage the steel locator ball 12 with one of the locator grooves 4A.

Thus when the operating shaft 4 is moved axially, the steel locator ball 12 successively engages with the locator grooves 4A. At this time, the rotary pin 11 successively moves to the positions of corresponding selector wheels 5 to engage with internal engagement recesses 5A formed at the inner peripheral surfaces of the selector wheels 5. Thus the selector wheel 5 of the desired row can be located by axially moving the operating shaft 4.

The printer frame 3 is further equipped with an indicator 10 movable along the display window 8 in parallel with the axis of the operating shaft 4. The indicator 10 is connected to the operating shaft 4 to be only rotatable relative thereto and to move integrally with the operating shaft 4 in the axial direction. The indicator 10 is formed with a pointer 10A which projects into the display window 8. The pointer 10A points to the selector wheel 5 of the desired row selected by the operating shaft 4.

Each endless printing band 7 is formed at separate regions on its outer peripheral surface with prescribed numbers of types 7A and display characters 7B. Specifically, half of the outer periphery of each endless printing band 7 is formed with a plurality of types 7A and the other half of the outer periphery thereof is formed with a plurality of display characters 7B. A blank section 7C is formed at each boundary region between the group of types and the group of display characters and, as explained later, the blank sections 7C face the display window 8 and the ink roller access opening 9 when the endless printing band 7 is at the terminal portion of its movement range.

The portion of the inner peripheral surface of the endless printing band 7 opposite the types 7A is made flat and the portion thereof opposite the display characters 7B is formed with low drive projections 7D and high drive projections 7E each engageable with peripheral engagement notches 5B of the selector wheel 5.

The high drive projections 7E are provided at portions opposite display characters 7B located substantially in the middle of the plurality of display characters 7B. The number thereof can be freely set in light of the numbers of the types 7A and the display characters 7B and the like to extend over a prescribed region on the inner peripheral surface of the endless printing band 7.

When the selector wheel 5 is rotated, the low drive projections 7D and the high drive projections 7E engage with the peripheral engagement notches 5B of the selector wheel 5 to rotate the endless printing band 7 and enable a desired type 7A to contact the ink roller R at the ink roller access opening 9.

Plural movable stop members 14 associated with the respective selector wheels 5 are mounted on the printing apparatus frame 3 between the selector wheels 5 and the type bearing member section 6 and inside the endless printing bands 7 wound about the selector wheels 5 and the type bearing member section 6.

Specifically, a stop guide 3B is provided to project from the printing apparatus frame 3 and this stop guide 3B fits into elongate guide windows 14C formed at the center portions of the movable stop members 14. The movable stop members 14 can move to some degree in the directions of approaching and separating from the selector wheels 5.

Each movable stop member 14 is formed at one end with a pair of regulating boss portions 14A for engaging the peripheral engagement notches 5B of the selector wheel 5 and at the other end thereof with an elastic section 14B.

The elastic section 14B has a bifurcated engagement spring section 14D. The bifurcated engagement spring section 14D is formed at its tip portion with outward projecting engagement pieces 14E. The tip surfaces of engagement pieces 14E are formed as slanted surfaces 14F that splay toward the tip end. A stop bearing member 15 is disposed between the movable stop members 14 and the type bearing member section 6. As shown in FIG. 2, the stop bearing member 15 is formed integrally with the printing apparatus frame 3. The surfaces of the stop bearing member 15 facing the movable stop members 14 are formed as bearing member side slanted surfaces 15A which abut on the slanted surfaces 14F of the engagement pieces 14E. The movement of the movable stop members 14 is restricted by the abutment of the slanted surfaces 14F and the bearing member side slanted surfaces 15A.

In the normal selectable state, the movable stop members 14 are individually urged toward the selector wheels 5 by the action of the elastic sections 14B. An upper gap S1 is formed between the elongate guide windows 14C and the stop guide 3B so that the movable stop members 14 can move downward in the drawings and also return.

The printing apparatus frame 3 is provided between the selector wheels 5 and the type bearing member section 6 with presser frames 3C, 3D for preventing outward deviation of the endless printing bands 7. As shown in FIGS. 1 and 2, in the normal type selectable state of the printing apparatus 1 configured in this manner, a desired row can be selected by moving the operating shaft 4 in the axial direction, whereafter a desired type 7A can be selected by rotating the operating shaft 4 either clockwise or counterclockwise at that row so as to rotate the endless printing band 7 via the selector wheel 5 and stopping the rotation of the operating shaft 4 at the position where the desired display character 7B of the endless printing band 7 can be seen through the display window 8.

In this selected state, the type 7A corresponding to the selected display character 7B is set on the type bearing member section 6 and exposed at the ink roller access opening 9. Printing can be effected by turning the ink roller R to apply ink to this type 7A and pressing the whole printing appratus 1 onto a label by, for example, operating a hand lever (not shown) or the like.

Figure 3:
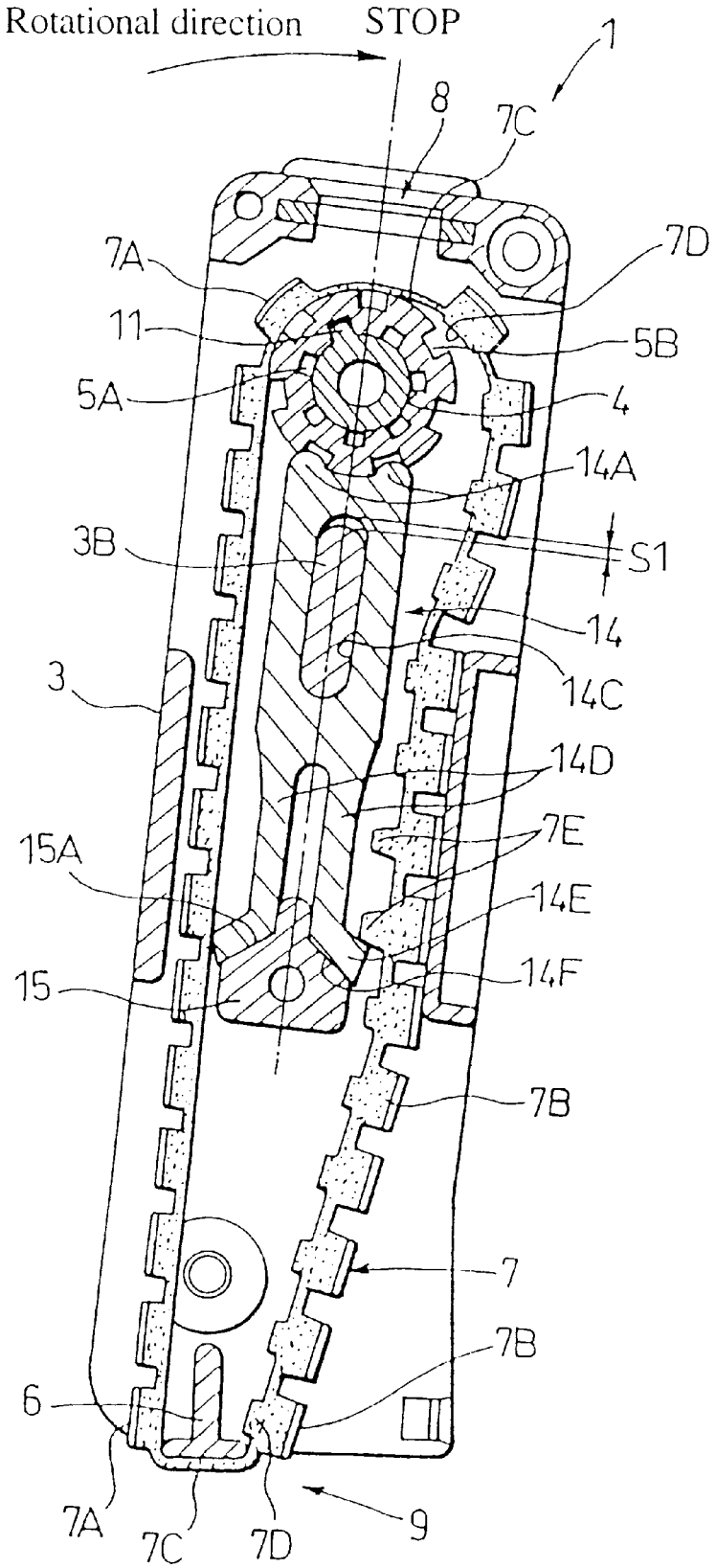
FIG. 3 is a sectional view showing an endless printing band of the printer shown in FIG. 1 when rotated to the rotation-prevented state.

FIG. 3 is a sectional view showing an endless printing band 7 when rotated clockwise in the drawing to the rotation-prevented state. This is an example where the operating shaft 4 was operated to rotate the selector wheel 5 until the endless printing band 7 rotated clockwise by an amount causing the blank sections 7C to come opposite the display window 8 and the ink roller access opening 9 and a high drive projection 7E of the endless printing band 7 to engage with one engagement piece 14E (right side of the drawing) of the elastic section 14B of the movable stop member 14.

The engagement between the high drive projection 7E and the engagement piece 14E therefore prevents the selector wheel 5 from rotating even if an attempt is made to rotate the selector wheel 5 further, whereby positioning of display characters 7B of the endless printing band 7 at the ink roller access opening 9 is avoided and fouling of display characters 7B by the ink roller R is prevented.

Figure 4:
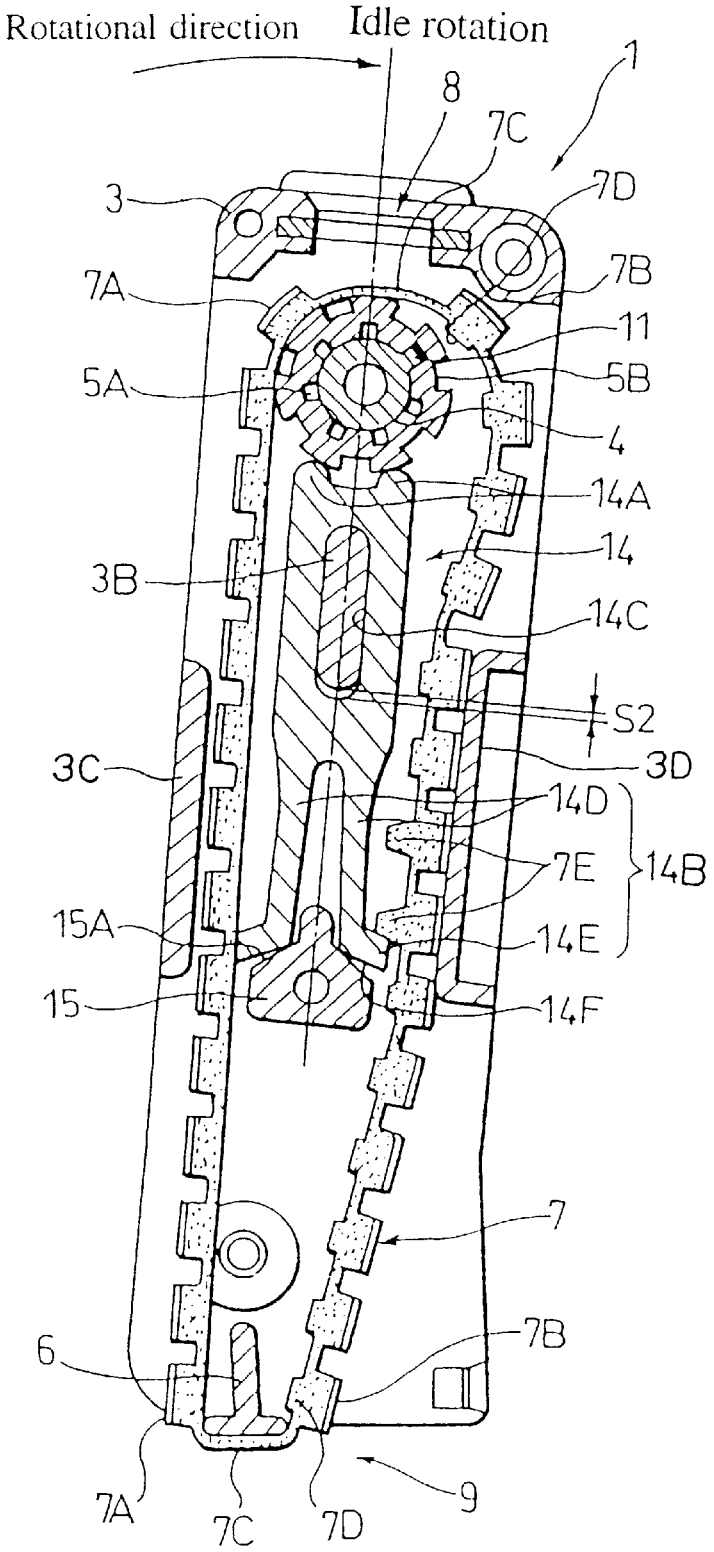
FIG. 4 is a sectional view showing the idle rotation state of a selector wheel.

FIG. 4 is a sectional view showing the idle rotation state of a selector wheel 5. In the foregoing rotation-prevented state, if an attempt is made to forcibly rotate the selector wheel 5 further, the peripheral engagement notches 5B of the selector wheel 5 escape from the regulating boss portions 14A of the movable stop members 14 to ride thereon in the illustrated state.

Specifically, the movable stop member 14 moves downward in the drawing guided by the stop guide 3B, whereby a lower gap S2 occurs between the elongate guide window 14C and the stop guide 3B, the slanted surfaces 14F of the elastic section slide on the bearing member side slanted surfaces 15A, the legs of the bifurcated engagement spring section 14D of the elastic section 14B spread laterally outward, and the engagement between the engagement piece 14E and the high drive projection 7E of the endless printing band 7 is strengthened.

In this state, the selector wheel 5 rotates idly because slack develops in the endless printing band 7 between the portion of the blank section 7C on the upper side and the portion of the engagement piece 14E so that the low drive projections 7D escape from the peripheral engagement notches 5B of the selector wheel 5.

Since the engagement portion between the engagement piece 14E and the high drive projection 7E is located downstream in the direction of rotation of the selector wheel 5 and the endless printing band 7 and, further, the presser frames 3C and 3D restrain the endless printing band 7 and keep it from bulging outward, the amount of slack developed between the selector wheel 5 and the endless printing band 7 is sufficient to ensure idle rotation of the selector wheel 5.

The selector wheel 5 can therefore rotate idly when an excessive external force acts thereon. Moreover, while the selector wheel 5 rotation itself acts more on the regulating boss portions 14A of the movable stop member 14 than on the endless printing band 7, no hindrance to type selection arises owing to wear of the movable stop member 14 since the movable stop member 14 is harder than the endless printing band 7.

If the selector wheel 5 is rotated in the opposite (counterclockwise) direction, the engagement between the peripheral engagement notches 5B and the regulating boss portions 14A is reestablished and the elasticity of the movable stop member 14 restores it to its original position shown in FIG. 1.

Figure 5:
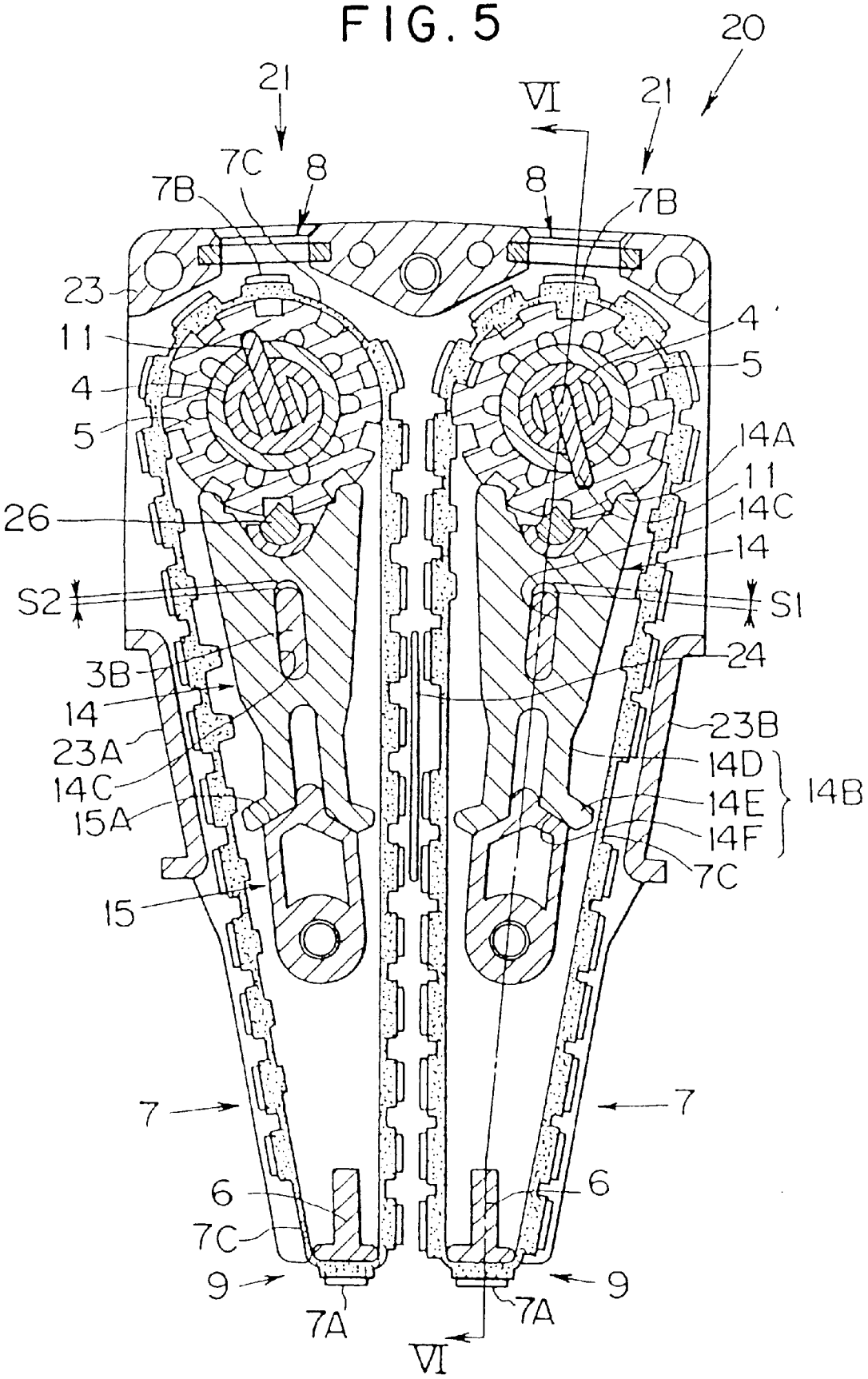
FIG. 5 is sectional view of a printer according to the second aspect of the invention.
Figure 6:
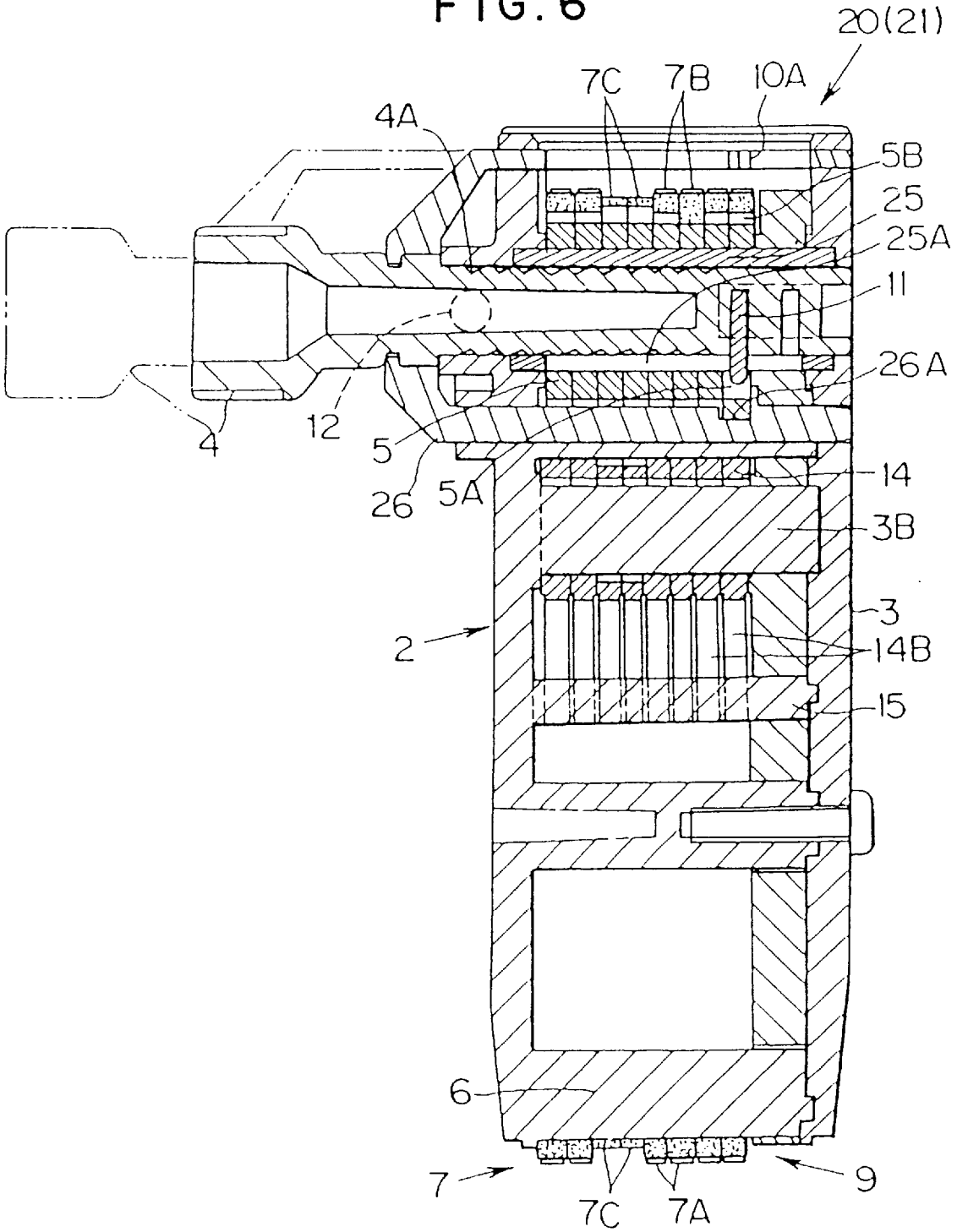
FIG. 6 is a sectional view taken along line VI—VI in FIG. 5.

FIGS. 5 and 6 are sectional views of a dual printer 20 according to the second aspect of the invention. FIG. 6 is a sectional view taken along line VI—VI in FIG. 5. The printer 20 is constituted by combining two printers 21 of substantially the same structure. Like portions to those of the printer 1 are assigned like reference symbols in the drawings and will not be explained in detail. Only structural features differing from those of the printer 1 will be explained.

A first presser frame 23A and a second presser frame 23B of the printer frame 23 of the printer 20 are formed substantially laterally symmetrical and a guide plate 24 is provided midway between them, thereby ensuring smooth movement of endless printing bands 7.

Sleeves 25 are fitted in the printer frame 23 to be rotatable about their axes. Selector wheels 5 are supported on the sleeves 25 and operating shafts 4 are inserted into the sleeves 25. The sleeves 25 are formed in the axial direction with slits 25A (FIG. 6). Rotary pins 11 erected on the operating shafts 4 are inserted into the slits 25A and the tips of the rotary pins 11 engage with internal engagement recesses 5A of the selected selector wheels 5.

On the other hand, the operating shafts 4 are fitted with co-rotation prevention rods 26 rods for permitting rotation of only the selected selector wheels 5. Each co-rotation prevention rod 26 is fitted on the associated operating shaft 4 to be rotatable only in parallel with and relative to the operating shaft. It is mounted to be movable relative to the printing apparatus frame 23 only in its axial direction and engages with a single peripheral engagement notch 5B of each associated selector wheel 5. The co-rotation prevention rod 26 is formed at a location facing the rotary pin 11 with a notch 26A for permitting rotation of the selector wheel 5 engaged by the rotary pin 11.

Therefore, since only the specific selector wheel 5 selected by the operating shaft 4 can rotate and the peripheral engagement notches 5B of the other selector wheels 5 are engaged with the co-rotation prevention rod 26, the selector wheels 5 adjacent to the specific selector wheel 5 being rotated are prevented from rotating so that no endless printing band 7 other than the selected and operated endless printing band moves.

Figure 7:
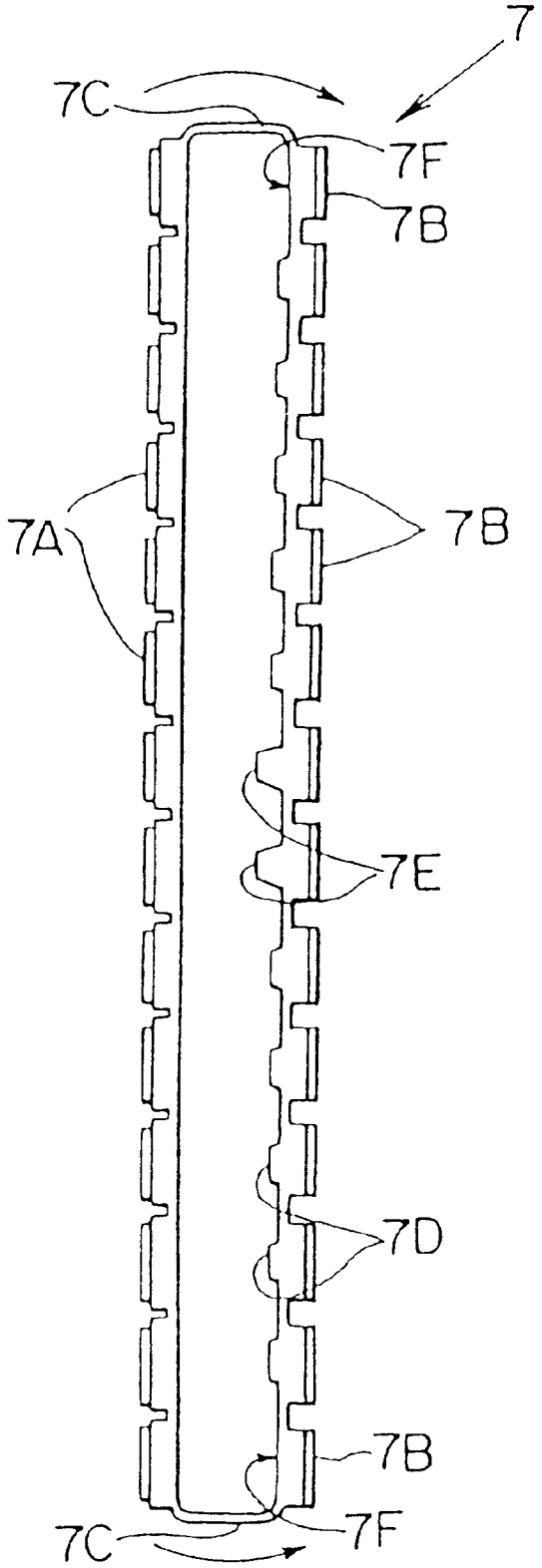
FIG. 7 is a side view of an endless printing band in the second aspect.

FIG. 7 is a side view of an endless printing band 7. The number of low drive projections 7D formed on the inner peripheral surface of the endless printing band 7 is two less than in the case of the printing apparatus 1 (FIG. 1).

Specifically, the inner peripheral surface portions at the display characters 7B adjacent to the blank sections 7C on the downstream side thereof in the direction of rotation of the endless printing band 7 are not formed with low drive projections 7D but are formed as flat portions 7F.

Although the illustrated example shows a pair (two) of flat portions 7F on the inner peripheral surface of the endless printing band 7, insofar as the ability to rotationally drive the endless printing band 7 by the selector wheel 5 can be maintained, it is possible to further facilitate the occurrence of idle rotation by providing the inner peripheral surface of the endless printing band 7 with two sets of two side-by-side flat portions 7F (total of four).

Since the dual printer 20 of this configuration provides the same effects as that shown in FIG. 1 and other figures, in can reliably prevent fouling of the display characters 7B by the ink roller R without damaging the endless printing bands 7.

Figure 8:
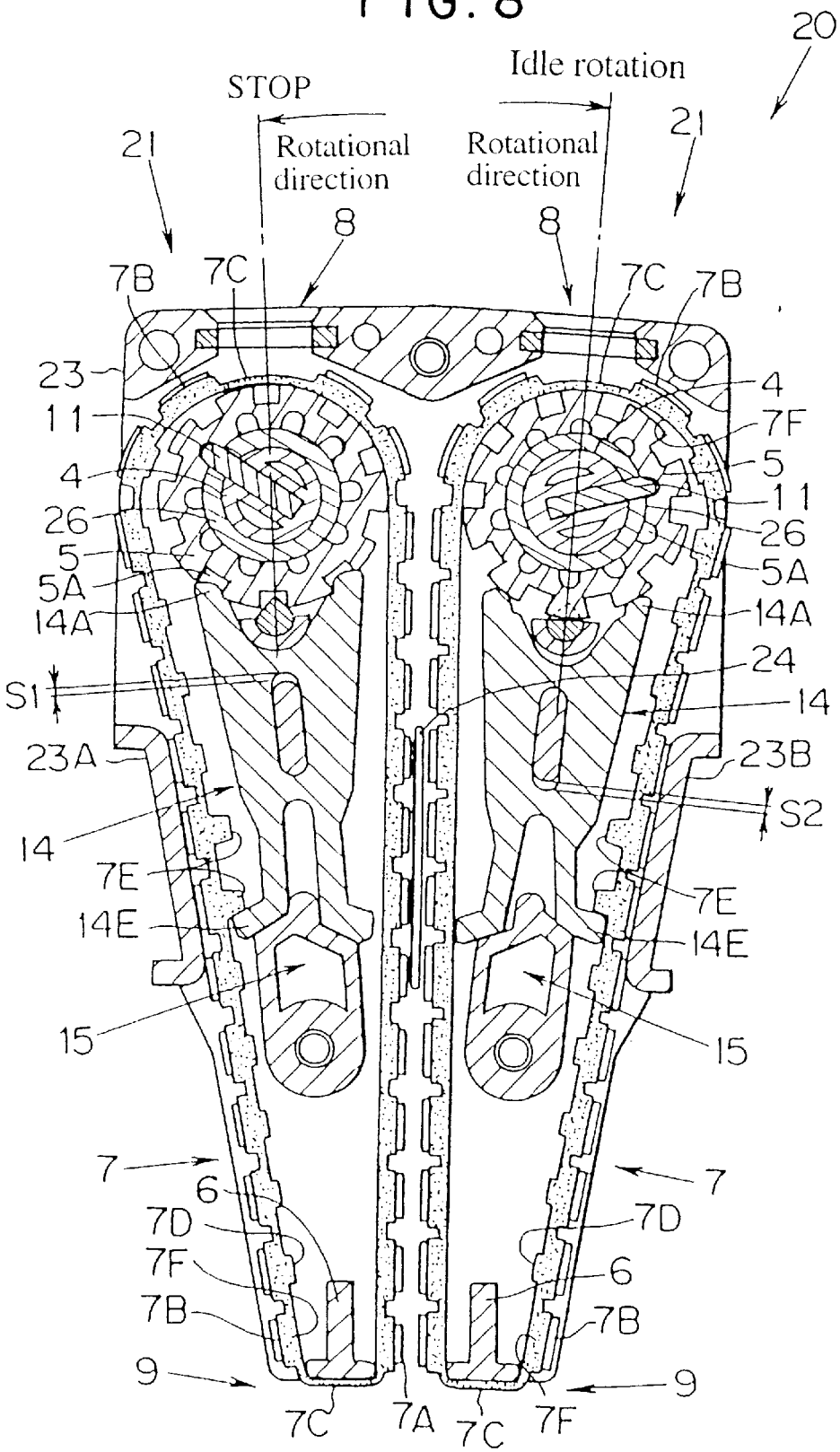
FIG. 8 is a sectional view showing the rotation-prevented state of endless printing bands and the idle rotation state of selector wheels.

Specifically, as shown in FIG. 8, taking the printer 21 on the right side by way of example, when a high drive projection 7E of the endless printing band 7 engages one of the engagement pieces 14E of the movable stop member 14 owing to rotation of the selector wheel 5 in the clockwise direction, further rotation of the selector wheel 5 is prevented (rotation-prevented state).

If the selector wheel 5 of the printing apparatus 21 on the right side of FIG. 8 is rotated clockwise in an attempt to cause further clockwise rotation from the rotation-prevented state, the selector wheel 5 rides up on the regulating boss portions 14A and assumes an idly rotating state owing to separation of the outer peripheral surface of the selector wheel 5 in the direction of rotation from the inner peripheral surface of the endless printing band 7 including the flat portions 7F (with no drive projections). In other words, as is clear from the drawings, the endless printing band 7 exhibits a slack state relative to the selector wheel 5, giving rise to idle rotation.

To be more specific, since the inner peripheral surface at the display character 7B immediately to the right in the figure from the blank section 7C positioned at the display window 8 is a flat portion 7F with no low drive projection 7D, engagement between the selector wheel 5 and the endless printing band 7 easily releases, whereby slack tends to develop in the endless printing band 7 to enable ready transition to the idle rotation state.

Since the other operations and effects are the same as those of the first aspect, they are not described in detail here.

Like the printer according to the second aspect described in the foregoing, that according to the first aspect shown in FIGS. 1 to 4 can also be configured to facilitate the development of slack in the endless printing bands 7 so as to enable ready transition of the selector wheels 5 to the idle rotation state.

When the diameter of the selector wheels 5 according to the first aspect are made smaller than the selector wheels according to the second aspect, the development of slack in the endless printing bands 7 and the transition of the selector wheels 5 to the idle rotation state can be facilitated by defining the height of the low drive projections 7D at positions corresponding to the flat portions 7F to fall within a prescribed range.

Further, when these selector wheels 5 are larger than in the second aspect (FIG. 5), the idle rotation state is readily exhibited if the flat portions 7F formed on the inner peripheral surfaces of the endless printing bands 7 are made equivalent to two characters to the left and right of the blank sections 7C.

Figure 9:
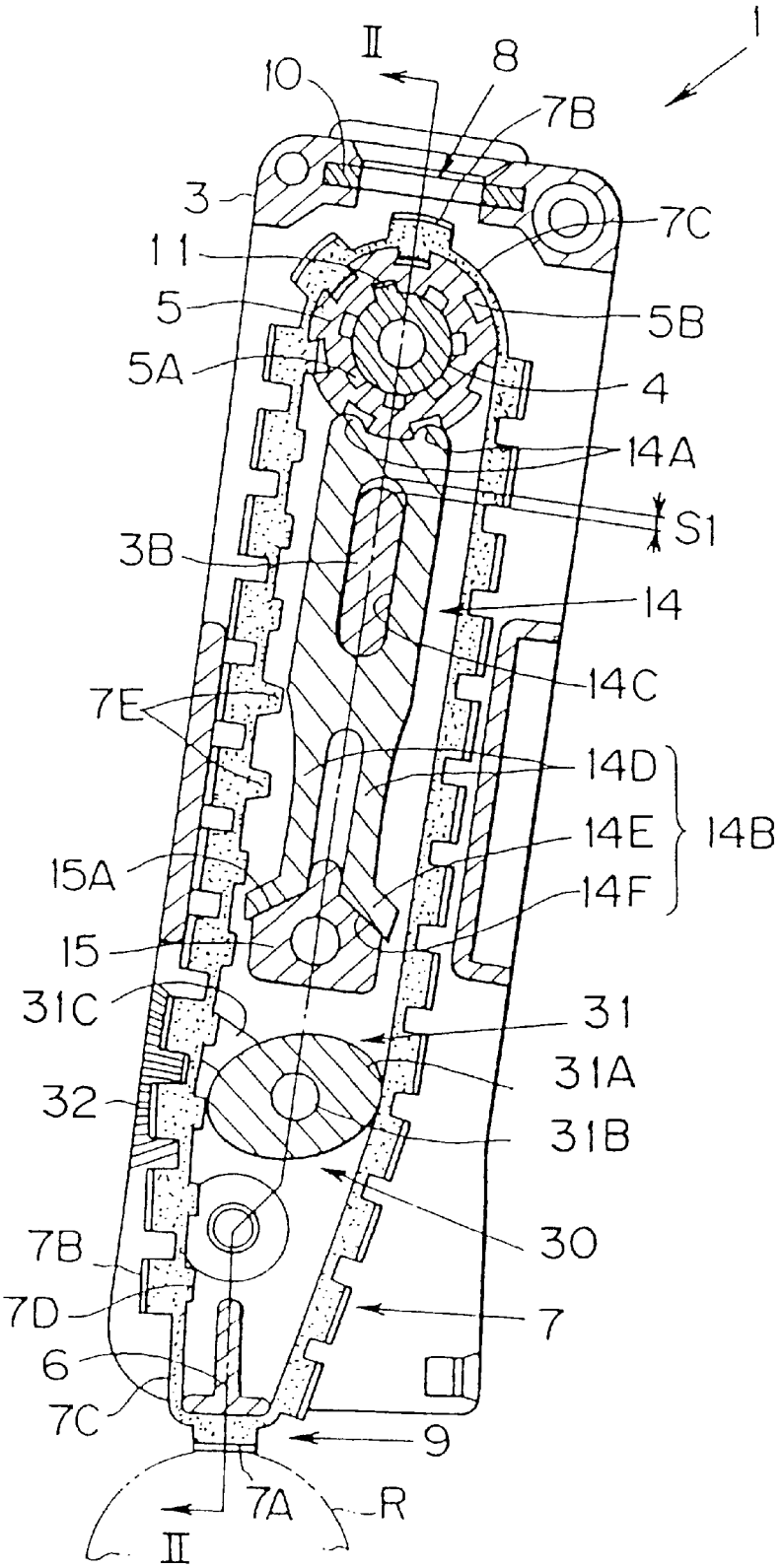
FIG. 9 is a sectional view of a printer according to the third aspect of the invention.
Figure 10:
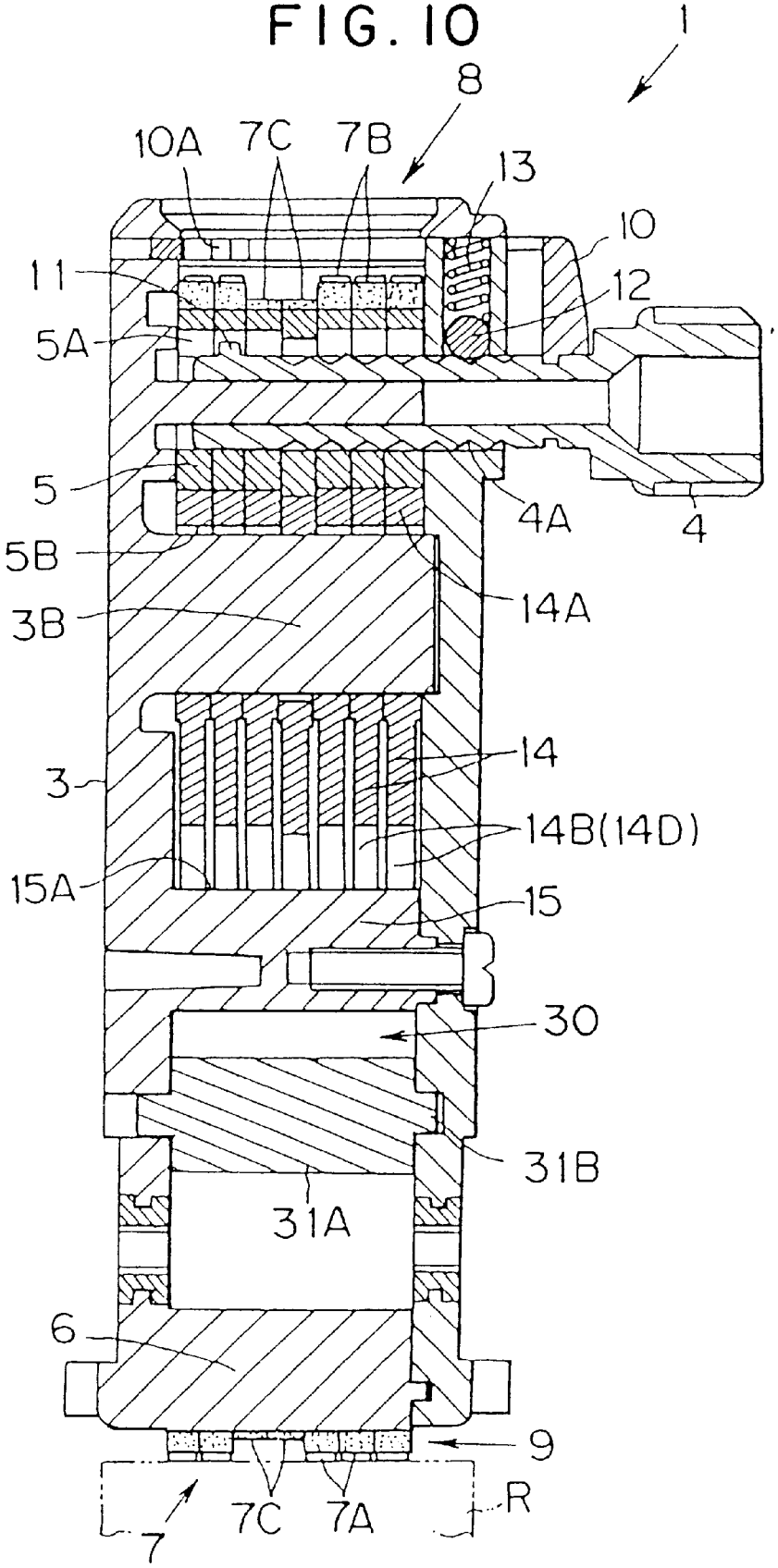
FIG. 10 is a sectional view taken along line II—II in FIG. 9.
Figure 11:
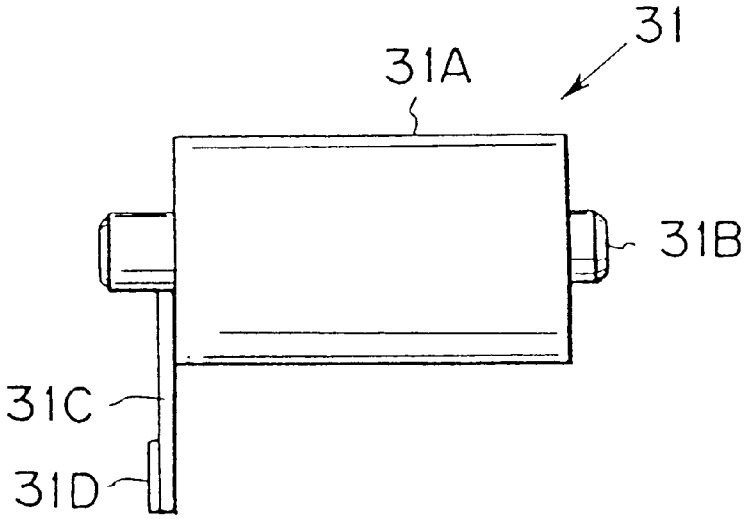
FIG. 11 is a side view of an adjuster.

FIGS. 9 and 10 are sectional views of a printing apparatus according to the third aspect of the invention. A tension adjustment mechanism 30 for the endless printing bands is disposed within the endless printing bands 7 at a location between the stop bearing member 15 and the type bearing member section 6. The tension adjustment mechanism 30 has an adjuster 31 (cam member). As shown in FIG. 11, the adjuster 31 is integrally formed of a sectionally elliptical main body 31A, cam adjustment rotary shafts 31B, an adjustment arm 31C and an engaging ridge 31D.

Specifically, the sectionally elliptical main body 31A is provided on opposite end surfaces with cam adjustment rotary shafts 31B. The sectionally elliptical main body 31A is rotatably supported on the printing apparatus frame 3 by the cam adjustment rotary shafts 31B. When the sectionally elliptical main body 31A is rotated, its outer peripheral portion makes and breaks contact with the inner peripheral surfaces of the endless printing bands 7.

One end surface of the sectionally elliptical main body 31A is formed with the adjustment arm 31C extending perpendicular to the cam adjustment rotary shaft 31B, and the engaging ridge 31D is provided on the tip portion of the adjustment arm 31C to face the printer frame 3.

Figure 12:
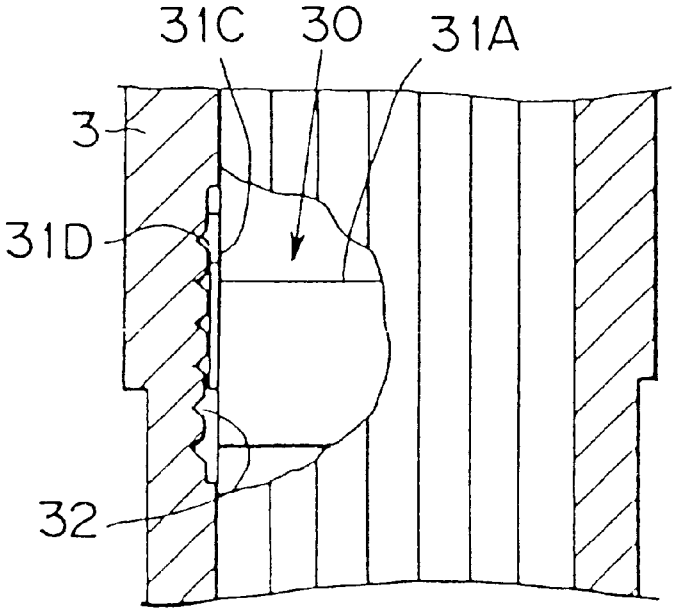
FIG. 12 is a partially cut-away enlarged side view of an essential portion of a printer frame and an adjuster section.

On the other hand, as shown in FIG. 12, a surface of the printer frame 3 lying perpendicular to the drawing sheet is formed with multiple radially extending cam adjustment grooves 32 with which the engaging ridge 31D can engage. Other points are the same as shown in FIGS. 1 and 2.

At the time assembly of the printer at the factory, for example, the attitude or relative position of the sectionally elliptical main body 31A with respect to the endless printing bands 7 can be adjusted by rotating the sectionally elliptical main body 31A about the cam adjustment rotary shafts 31B to bring the engaging ridge 31D of the adjustment arm 31C into engagement with a desired one of the cam adjustment grooves 32 of the printer frame 3.

As shown in FIG. 9, for example, the tension of the endless printing bands 7 can be increased by positioning the sectionally elliptical main body 31A to thrust toward the endless printing bands 7 since this causes the sectionally elliptical main body 31A to abut relatively strongly on the inner peripheral surfaces of the endless printing bands 7.

Figure 13:
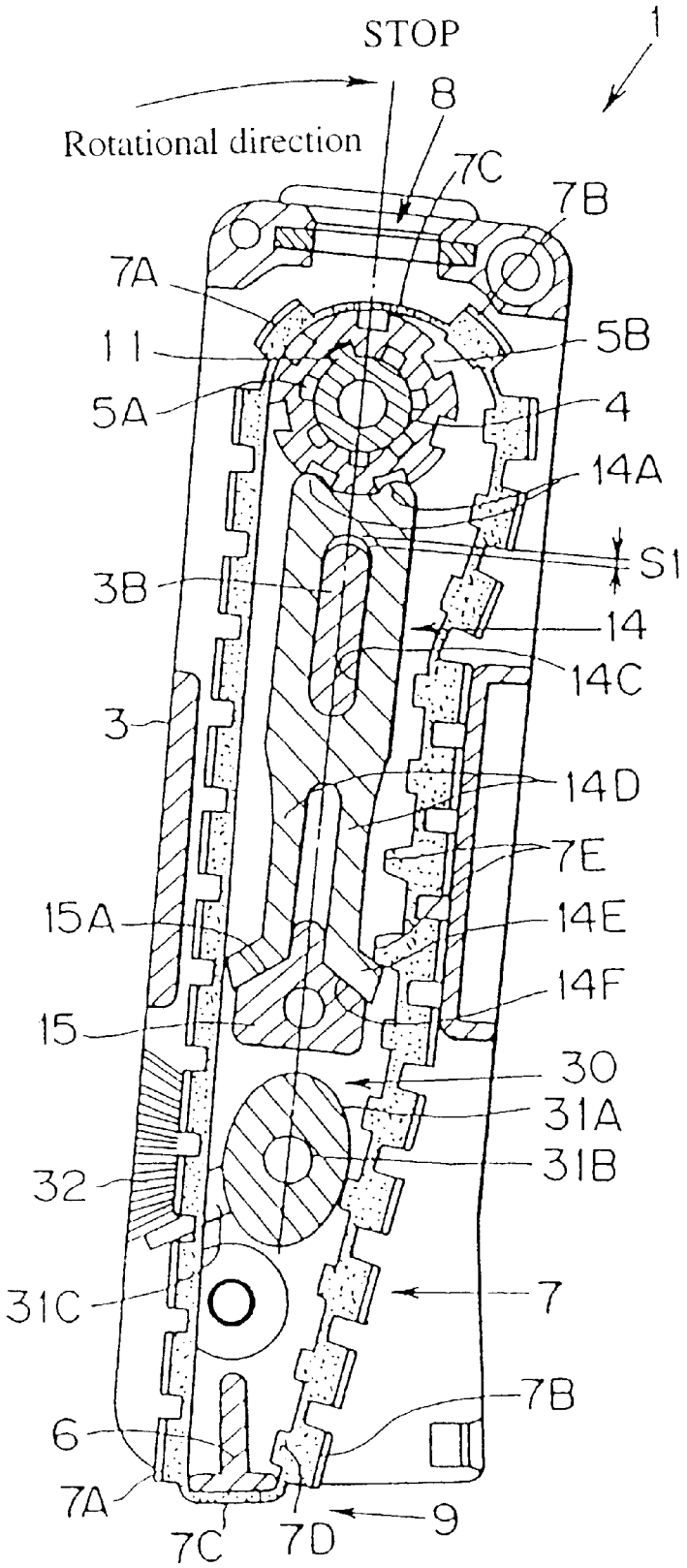
FIG. 13 is a sectional view showing an endless printing band of the printer shown in FIG. 9 when rotated to the rotation-prevented state.
Figure 14:
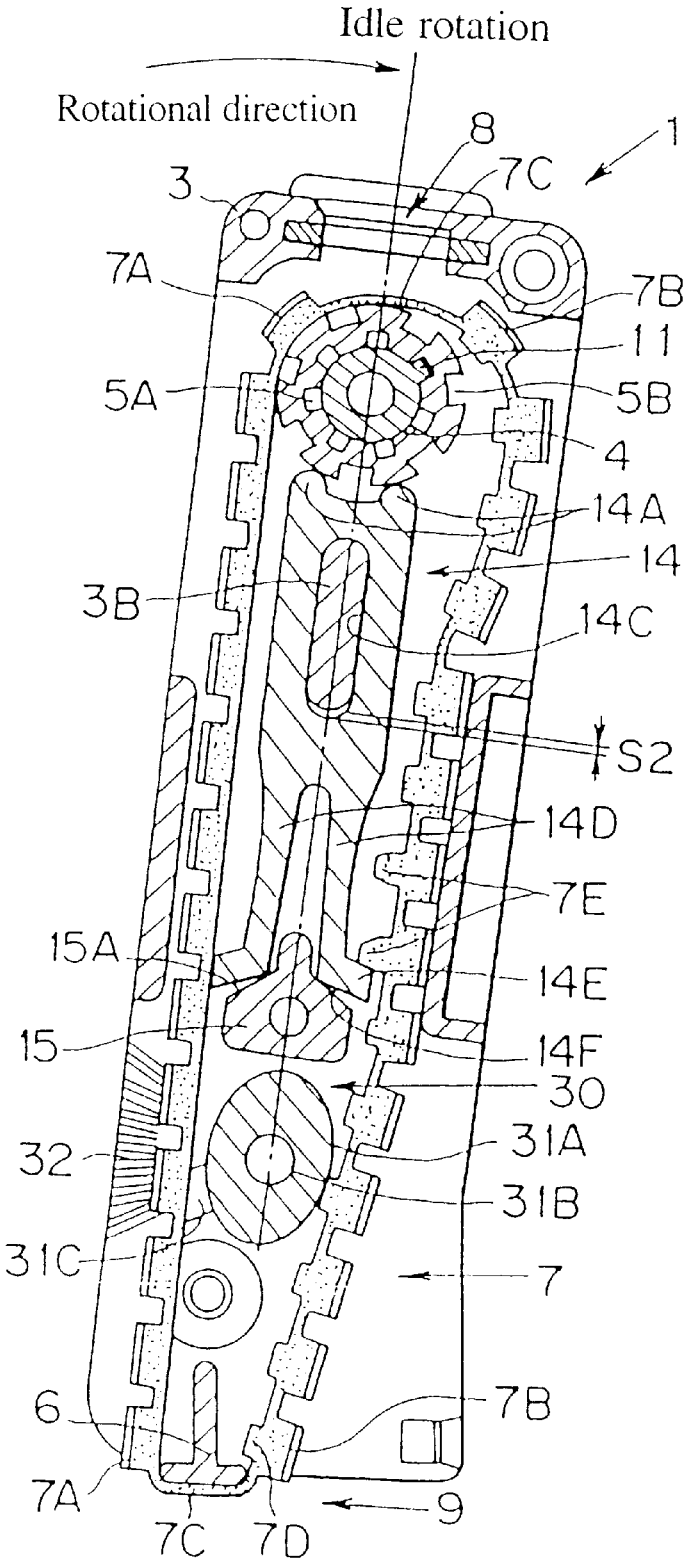
FIG. 14 is sectional view showing the idle rotation state of a selector wheel.

Otherwise, if the sectionally elliptical main body 31A is rotated to the attitude shown in FIGS. 13 and 14, the adjuster 31 does not contact the inner peripheral surfaces of the endless printing bands 7, whereby the tension of the endless printing bands 7 can be reduced.

Adjustment of the rotation angle of the adjuster 31 thus enables adjustment of the tension of the endless printing bands 7 for ensuring their proper rotation and further enables the condition of slackening of the endless printing bands 7 in the idle rotation state shown in FIG. 14 and the effect of the idle rotation of the selector wheel 5, which is related to the slackened condition, to be brought within the desired ranges.

The set angular position of the adjuster 31 can also be adjusted to readjust the tension of the endless printing bands 7 in response to elongation or slackening of the endless printing bands 7 during use of the printing apparatus.

Since, as explained in the foregoing, the invention provides the stop members, each having regulating boss portions and an elastic section, and further provides the stopper bearing member on which the elastic sections abut to restrict movement of the movable stopper members, it enables the selector wheels to ride up and rotate idly, thereby preventing fouling of the endless printing bands by the ink roller and reducing the load on the endless printing bands 7.

Further, since an attempt to rotate a selector wheel from its rotation-prevented state causes it to rotate idly owing to separation between the outer peripheral surface of the selector wheel in the direction of rotation and the inner peripheral surface of the endless printing band, no load arises owing to contact friction between the two surfaces.

When the tension adjustment mechanism is provided within the endless printing bands, moreover, the degree of endless printing band tensioning can be simply adjusted by rotating the adjuster within a prescribed range.

We claim:

1. A printing apparatus having at least one endless printing band formed on its outer peripheral surface with multiple types and display characters and wound about a selector wheel and a type bearing member section and enabling selection of a desired type of the endless printing band, a movable stop member provided between the selector wheel and the type bearing member section and having one end portion formed with at least one regulating boss portion for engaging the selector wheel and having at another end portion formed with an elastic section having at least one engagement piece, a stop bearing member for restricting movement of the movable stop member by abutting on the elastic section of the movable stop member, and at least one drive projection provided on an inner peripheral surface of the endless printing band to be engageable with the engagement piece of the elastic section of the movable stop member, engagement between the drive projection and the engagement piece with movement of the endless printing band causing movement of the movable stop member to enable release of the engagement between the selector wheel and the regulating boss section.

2. The printing apparatus of claim 1 further comprising a stop guide for guiding the movable stop member in its movement direction.

3. The printing apparatus of claim 1, wherein the elastic section has a bifurcated engagement spring section.

4. The printing apparatus of claim 1, wherein the stop bearing member has a slanted surface for bearing the elastic section.

5. The printing apparatus of claim 1, wherein the inner peripheral surface of the endless printing band is formed with at least one drive projection at a portion opposite a display character and is made flat at a portion opposite a type.

6. The printing apparatus of claim 1, wherein the outer peripheral surface of the endless printing band is formed with at least one blank section with no types and the inner peripheral surface opposite at least one display character adjacent to a side of the blank section in the direction of rotation is made a flat section.

7. The printing apparatus of claim 1, further comprising a cam member whose rotational position can be adjusted is provided within the endless printing band to be rotatable into and out of contact with the inner peripheral surface of the endless printing band.

8. The printing apparatus of claim 7, wherein the cam member has a cam adjustment rotary shaft and an adjustment arm perpendicular to the cam adjustment rotary shaft.

9. The printing apparatus of claim 7, further comprising a printer frame on which the selector wheel and the type bearing member section are provided, the printer frame having an adjustment groove section enabling adjustment of the rotational position of the cam member.

10. The printing apparatus of claim 7, wherein the cam member is sectionally elliptical.

11. A printing apparatus having at least one endless printing band formed on its outer peripheral surface with multiple types and display characters and wound about a selector wheel and a type bearing member section and enabling selection of a desired type of the endless printing band, a stop member provided between the selector wheel and the type bearing member selection and at least one drive projection provided on an inner peripheral surface of the endless printing band to be engageable with the stop member, engagement between the drive projection and the stop member with movement of the endless printing band producing slack in the endless printing band to enable idle rotation of the selector wheel, a cam member within the endless printing band, the cam member having a rotational position which can be adjusted within endless printing band to be rotatable into and out of contact with the inner peripheral surface of the endless printing band.

12. The printing apparatus of claim 11, wherein the cam member is sectionally elliptical.

13. The printing apparatus of claim 11, wherein the cam member has a cam adjustment rotary shaft and an adjustment arm perpendicular to the cam adjustment rotary shaft.

14. The printing apparatus of claim 11, further comprising a printer frame on which the selector wheel and the type bearing member section are provided is formed with an adjustment groove section enabling adjustment of the rotational position of the cam member.

* * * * *